United States Patent [19]

Isaacson

[11] 4,374,470

[45] Feb. 22, 1983

[54] GEM RING WITH INTERCHANGEABLE SETTINGS

[76] Inventor: E. Arnold Isaacson, 4033 Milky Way, Salt Lake City, Utah 84117

[21] Appl. No.: 234,736

[22] Filed: Feb. 17, 1981

[51] Int. Cl.[3] ..... A44C 17/04

[52] U.S. Cl. ..... 63/29 R

[58] Field of Search ..... 63/29 R, 26, 27

[56] References Cited

U.S. PATENT DOCUMENTS

| | | | |
|---|---|---|---|
| 1,160,723 | 11/1915 | Lander | 63/29 R |
| 1,712,171 | 5/1929 | Rochas | 63/29 R |
| 1,864,371 | 6/1932 | Prussian | 63/29 R |
| 3,307,375 | 3/1967 | Estrin et al. | 63/29 RX |

FOREIGN PATENT DOCUMENTS

| | | | |
|---|---|---|---|
| 539033 | 11/1931 | Fed. Rep. of Germany | 63/29 |

*Primary Examiner*—F. Barry Shay

*Attorney, Agent, or Firm*—B. Deon Criddle

[57] ABSTRACT

A ring having a means for inserting a replaceable insert unit or cartridge containing a gem stone or any other type of setting such that the insert unit is securely held in place in a mounting but can be readily replaced by a similar unit containing another setting. The mounting is adapted to hold a sleeve with a hinged door that fits across the inside opening. A setting is positioned in a crown and the setting and crown are soldered within a casing having projecting edges that fit snugly within and project through a sleeve that is soldered inside the mounting. The gem stone or other setting, the crown (if used) and the casing comprise a replaceable cartridge. The projecting edges of the casing serve as a setting guard. The hinged door, which locks to hold the assembly together, has a hole therethrough through which the pavilion of a setting may protrude if required.

6 Claims, 6 Drawing Figures

GEM RING WITH INTERCHANGEABLE SETTINGS

BACKGROUND OF THE INVENTION

1. Field of the Invention

This invention relates to finger rings, and is particularly concerned with providing a ring that will permit ready change of the gem stones or other settings mounted in the ring.

2. Prior Art

Various types of rings have been proposed in the past to include hinged boxes on the surfaces thereof so that materials can be secreted in the boxes and so that the surfaces of the box can be changed to present a different ring appearance from time-to-time. So far as I am aware, however, there has not heretofore been available a ring that will allow a setting to be displayed to the best advantage and that will readily allow for the insertion and display of gem stones or other settings of different shapes, sizes, types, colors, etc.

SUMMARY OF THE INVENTION

Objects of the Invention

A principal object of the present invention is to provide a ring that will permit the user thereof to change the settings, as desired. This will enable the user to have a variety of settings of different sizes, shapes, types, or colors that can be displayed in a single mounting.

Other objects are to provide such a ring that will securely hold the setting used in place, and that will permit the use of gem stones or settings of desired shape, size, type, color etc. to make a wardrobe of setthings available while using a single mounting thereby making the purchase of an entire new ring unnecessary.

Features of the Invention

Principal features of the invention include a ring comprising a mounting having an opening provided through a front surface thereof and intended to accommodate a variety of interchangeable settings. A hinged door is arranged so as to occlude an inner opening of the front of the mounting when shut. When open, the hinged door allows removal of the setting. As the hinged door swings toward the orifice in the ring to a closed position, the door rests flat against the inside of the setting and holds it snugly in place. If a faceted stone is to be used as a setting, it is positioned within a crown having spaced prongs that engage the stone to lock the crown and stone together. The crown configuration is such that when the crown and stone carried thereby are inserted into a casing, the crown, stone and casing are firmly positioned within the mounting. If a setting other than a faceted stone is to be used, it may be positioned within the casing without using a crown. The inside shape of the casing may be made to securely encase any shape of setting.

Additional features and objects of the invention will become apparent from the following detailed description of the presently preferred embodiment, as shown in the accompanying drawing.

THE DRAWING

In the drawing:

FIG. 1, is a top elevation view of a ring embodying the invention;

FIG. 2, a side elevation view of the ring of FIG. 1;

FIG. 3, a front plan view;

FIG. 4, an exploded perspective view showing the components of the ring of the invention in an exploded relationship;

FIG. 5, a fragmentary sectional view taken on the line 5-5 of FIG. 2; and

FIG. 6, a transverse section taken on the line 6-6 of FIG. 1.

DETAILED DESCRIPTION OF THE INVENTION

Figure 1:
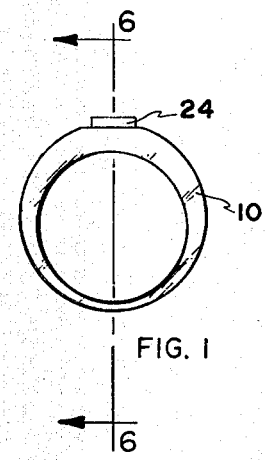
Figure 2:
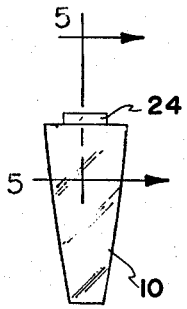
Figure 3:
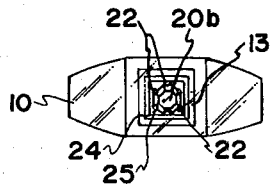
Figure 4:
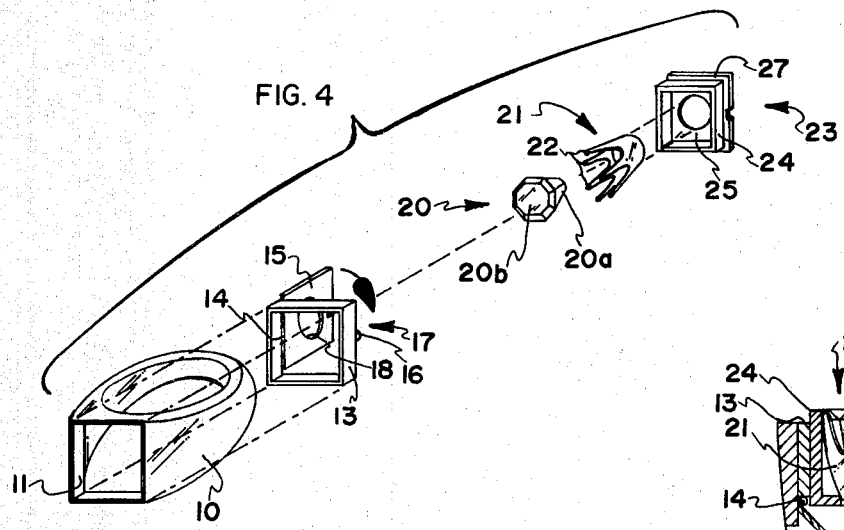
Figure 6:
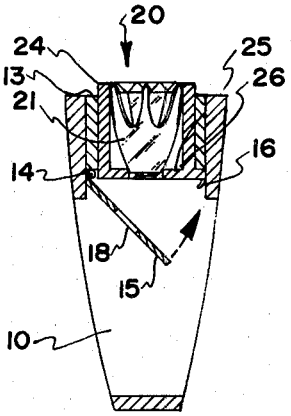
Figure 5:
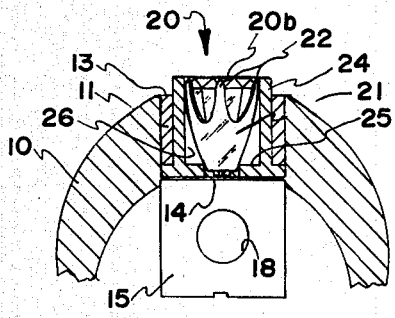

Referring now to the drawing:

In the illustrated preferred embodiment of the invention, the ring includes a mounting 10 of the usual circular configuration and preferably made of precious metal or the like. An opening 11 is provided through the upper or display surface of the mounting 10. Opening 11 may be of square, rectangular, circular, oval or other configuration, and a similarly shaped mounting assembly 12 includes a sleeve 13 that fits tightly within the opening 11 and that is soldered thereto. Sleeve 13 carries a hinge 14 at one inner side thereof and a door 15 is pivotally mounted to the hinge 14. A latch member 16 is carried by sleeve 13 at the side opposite hinge 14 and the latch member 16 cooperates with a latch member 17 on the door 15 to hold the door 15 against the sleeve 13 when in a closed position. The door 15 holds the surface of the flanges of a casing snugly in place as will be further explained. A hole 18 is provided centrally through the door 15, also for purposes to be further explained. As seen in FIGS. 1 through 5, when assembled, the sleeve 13 fits within the opening 11 and is soldered to mounting 10, as shown at 19.

When a faceted gem stone 20 such as is shown is to be placed in the mounting 10, it is positioned within a crown 21. As is conventional, the pavilion **20*a* of the stone is positioned to rest within the crown 21 and the prongs 22 of the crown are bent over the beveled surface 20*b* of the stone. The stone is thus securely held within the crown. The crown 21, with the stone 20 therein, is positioned within a casing 23 by inserting the crown within an upstanding surrounding stone guard edge 24 of the casing 23 until the crown securely rests within an inwardly projecting base 25 of the casing 23. The crown 21 is soldered to the base 25, as shown at contact point 26. The crown 21, soldered to the casing 23 at contact point 26, the stone, (which is secured to the crown by the bent prongs 22), and the casing 23**, make up a replaceable setting insert unit or cartridge.

The replaceable setting insert unit (cartridge) is readily inserted into the sleeve 13 by positioning the stone guard edge 24 upwardly from the inside of the ring through sleeve 13 and then closing the door 15 and locking it into position by interconnecting the latch members 16 and 17. A flange 27 projects outwardly from the casing edge 24 to engage the edges of sleeve 13 in order to keep the cartridge from passing fully through the opening in the sleeve 13. The door 15, when latched abuts the flange 27 to securely hold the replaceable insert unit (cartridge) in position.

When a faceted stone is used as a setting, the stone guard edge 24, which fits snugly within the sleeve 13 may project through the sleeve and from the ring band 10 to a position just beyond the outermost extremity of the stone 20. This protects the stone from chipping, scratching, or other damage. If a different setting is used, this edge of the cartridge may protrude to meet the needs of the different setting.

The hole in the door 18 further accommodates the pavilion 20*a* of a faceted gem stone 20, should such accommodation be necessary. While the hole is here shown in a round shape it will be apparent that it may vary to accommodate the shape of the pavilion used.

It will be apparent that other replaceable insert units, (cartridges) comprising a stone or other setting, a crown, (if a faceted stone is used) and a casing, as heretofore described, can be readily constructed and can be used in place of the replaceable gem insert until (cartridge) herein described. This will allow the user to readily change the setting and thereby change the front view appearance of the ring.

Although a preferred form of my invention is herein described, it is to be understood that the present disclosure is made by way of example and the variations are possible without departing from the subject matter coming within the scope of the following claims, which subject matter I regard as my invention.

I claim:

1. A finger ring comprising a mounting having an opening through the front thereof;

closure means fixed to the inside of the mounting and adapted to extend across the opening;

latch means to hold the closure means in position across said opening;

a replaceable insert unit adapted to fit in the opening and to be held in place by the closure means and the latch means, said insert unit including a setting projecting through the opening to the outer surface of the mounting, a crown in which the setting is inserted, the points of the crown being bent over the setting to hold the setting in the crown; and a casing in which the setting and crown are positioned, said casing including a setting edge guard projecting through the opening and around the setting.

2. A finger ring as in claim 1, wherein the setting edge guard projects beyond the setting.

3. A finger ring as in claim 2, wherein the casing has an opening therethrough to receive a pavilion of the setting.

4. A finger ring as in claim 3, wherein the closure means comprises a sleeve soldered in the opening of the front of the mounting and a door pivotally connected to the frame, said door having a central opening therethrough to receive the pavilion of the setting.

5. A finger ring as in claim 1, wherein the casing has an opening therethrough to receive a pavilion of the stone.

6. A finger ring as in claim 5, wherein the closure means comprises a sleeve soldered in the opening of the front of the mounting and a door pivotally connected to the frame, said door having a central opening therethrough to receive the pavilion of the setting.

* * * * *